US006210072B1

(12) United States Patent
Marelius

(10) Patent No.: US 6,210,072 B1
(45) Date of Patent: Apr. 3, 2001

(54) METHOD AND APPARATUS FOR EROSION PROTECTING A COAST

(76) Inventor: Fredrick Marelius, Norrtullsgatan 16 E, Stockholm (SE), 113 45

( * ) Notice: Subject to any disclaimer, the term of this patent is extended or adjusted under 35 U.S.C. 154(b) by 0 days.

(21) Appl. No.: 09/269,207

(22) PCT Filed: Sep. 25, 1997

(86) PCT No.: PCT/SE97/01618

§ 371 Date: Mar. 31, 1999

§ 102(e) Date: Mar. 31, 1999

(87) PCT Pub. No.: WO98/14667

PCT Pub. Date: Apr. 9, 1998

(30) Foreign Application Priority Data

Oct. 3, 1996 (SE) ..... 9603615

(51) Int. Cl.[7] ..... E02B 7/40; E02B 7/50

(52) U.S. Cl. ..... 405/100; 405/28; 405/92; 405/113

(58) Field of Search ..... 405/23, 25, 26, 405/28, 87, 92, 100, 113

(56) References Cited

U.S. PATENT DOCUMENTS 3,673,805 * 7/1972 Szyfter ..... 405/26
3,848,419 * 11/1974 Bowley ..... 405/26
3,971,221 7/1976 Greenleaf ..... 405/26
4,264,233 * 4/1981 McCambridge ..... 405/26
5,294,211 * 3/1994 Niimura ..... 405/26
5,304,005 * 4/1994 Loeffler-Lenz ..... 405/26

FOREIGN PATENT DOCUMENTS 2 035 470 1/1972 (DE) .
95/28527 10/1995 (WO) .

* cited by examiner

*Primary Examiner*—Eileen D. Lillis
*Assistant Examiner*—Tara L. Mayo
(74) *Attorney, Agent, or Firm*—Jacobson, Price, Holman & Stern, PLLC

(57) ABSTRACT

The present invention is a device and a method for protecting part of a coastline against erosion. The method uses the device as an elongated fin with a longitudinal axis lying generally in a horizontal plane. The fin is supported by a suspension arrangement so that it can swing in the horizontal plane. Adjusting the longitudinal axis of the fin, in the horizontal plane, causes the fin to deflect from the water flow a component that counteracts with a generally coast-parallel water flow component. This component originates from the water flow and/or from a wave that is not parallel with the coastline. The fin is carried by a suspension arrangement which enables the fin to swing in the horizontal plane. The suspension arrangement is constructed to increase the fin angle relative to the coastline when the direction of the waves relative to the coastline increases, and to decrease the fin angle relative to the coastline when the direction of the waves relative to the coastline decreases.

18 Claims, 3 Drawing Sheets

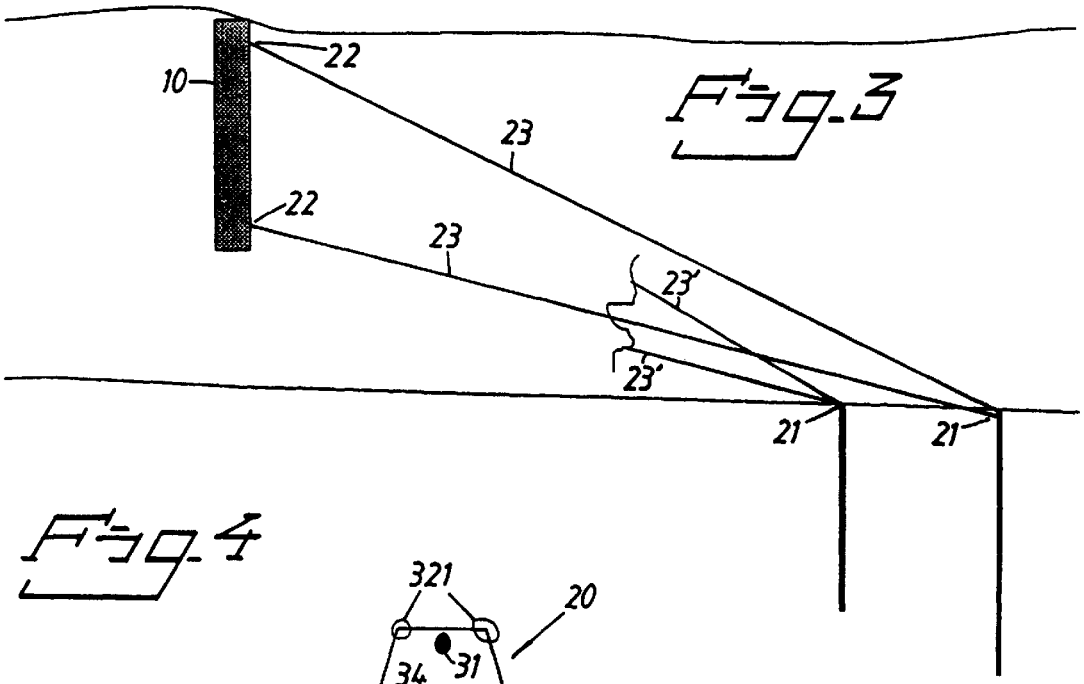
Fig. 3
Fig. 4
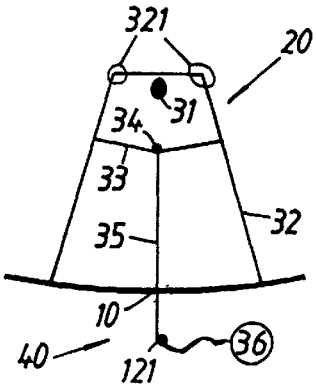
1
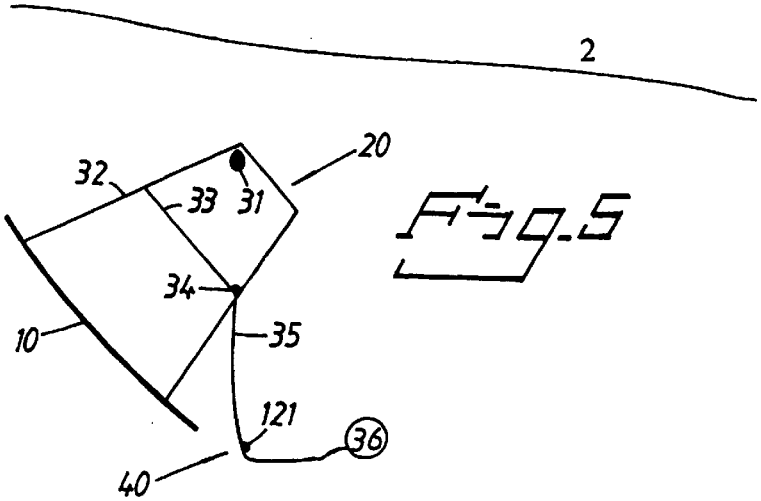
Fig. 5

METHOD AND APPARATUS FOR EROSION PROTECTING A COAST

BACKGROUND OF THE INVENTION

1. Field of the Invention

The present invention relates to a method of protecting part of a coastline against erosion, by placing in a wave breaking zone, a device to dampen water flow generated by the breaking waves.

The invention also relates to an arrangement for protecting a part of a coastline against erosion. The arrangement includes a device being placed in a wave breaking zone and adapted to dampen water flow generated by the breaking waves.

In a zone where the water is so shallow that waves have an influence on the sea bed, sea-bed material will be suspended by waves and transported inwards and outwards perpendicular to the coastline, this material settling at roughly the same rate as it was suspended, thereby leaving the coastline more or less intact. However, the water flow will often have a flow component along the coastline. Such a flow component occurs when waves are angled to the coastline in the breaking zone. This results in sand and other erosion material/beach and coast material being moved along the coastline. Sand that is washed away along the coast from one place to another is not always replaced to the same extent from a part of the coast located upstream. Thus, sandy beach can be washed away or built-up and extended even in the case of relatively small changes in the direction of the incoming waves at the part of the coast in question. This phenomenon whereby a sand beach is washed away and re-built can be amplified by general water flows in the coast region.

Such coast erosion is a well known problem and proposed solutions include the use of beach facings, wave breakers, groynes, artificial reefs, pneumatic wave dampers, artificial "seaweed" (bottom-secured oil-filled hoses) among other things.

One problem with these known solutions, however, is that they are very expensive to construct and are either built to provide the intended function for a specific predominant wave direction or to dampen incoming waves. None of the solutions is aimed at actively influencing the coast-parallel net loss of sediment along a heavily eroded coast section.

In reality, however, wave direction varies in a manner that cannot be fully anticipated, and consequently fixed structures along the coastline can sometimes give a less desirable result.

SUMMARY OF THE INVENTION

Accordingly, one object of the present invention is to provide a method that can be carried out effectively at low cost, and to provide an effective arrangement that can be manufactured and mounted at a relatively low cost and which will function effectively in the case of differing wave directions, and which is able to adjust automatically to an optimal setting with respect to variations in wave direction, such as variations that have been observed over long periods of time.

One object of the invention is therewith also to provide a corresponding method.

This object is achieved by using a device in the form of an elongated fin with a longitudinal axis lying in a horizontal plane. The method includes the step of providing a support for the fin so that it can swing in the horizontal plane. This is accomplished by adjusting the longitudinal axis of the fin in the horizontal plane. The fin deflects, from the water flow, a component that counteracts with a generally coast-parallel water flow component that originates from the water flow and/or from a wave that is not parallel with the coastline. This occurs when the angle of the wave direction relative to the coastline increases. Alternatively, when the angle of the wave direction relative to the coastline decreases, the suspension arrangement decreases the fin angle relative to the coastline.

The method is also achieved with the arrangement according to a device which is an elongated fin. The longitudinal axis of the fin is orientated in a chosen first fin orientation such as to cause the fin to deflect from the water flow a first flow component. The first flow component counteracts a coast-parallel water flow component originating from a general water flow and/or from a wave that is not parallel with the coastline. The fin is carried by a suspension arrangement which enables the fin to swing in the horizontal plane. The suspension arrangement is constructed to increase the fin angle relative to the coastline when the angle of the waves relative to the coastline increases, and when the angle of the waves relative to the coastline decreases, the suspension arrangement decreases the fin angle.

Further embodiments of the invention will be evident from the dependent claims.

The inventive arrangement can be considered fundamentally to include an elongated fin having a longitudinal direction that generally lies in the horizontal plane. The fin also suitably has a generally vertical extension, such as to be able to capture and dampen water flows that derive from the breaking waves. The fin is conveniently constructed from a buoyant material, so that the upper edge of the fin will lie essentially at the surface of the water. The fin is supported so as to be able to swing in the horizontal plane. The longitudinal axis of the fin is set in the horizontal plane to a selected orientation in which the fin deflects from the water flow a flow component along the fin. This current component gives rise to a coast-parallel, water-flow component that serves to counteract an undesired coast-parallel water flow, for instance a water flow that transports sand away from the coast section concerned. This undesired coast-parallel water flow may consist of a general water flow and/or of a flow component generated by a wave that falls obliquely to the coastline. The orientation of the fin relative to the coastline is then changed in dependence on changes in wave direction relative to the coastline, so that the current component, or rather the component parallel with the coastline, deflected by the fin is given a desired value for different angles defined by the waves with the coastline.

The fin suspension can be controlled by sensing, or detecting, the direction of incoming waves, and using the sensed wave direction to control setting means/suspension arrangements coupled to the fin. In preferred embodiments of the invention, the suspension may be designed to enable incoming waves themselves to set the fin to those directions permitted by the suspension arrangement. According to one embodiment of the invention, the suspension arrangement may include a mechanism that has two anchoring points that are mutually spaced along the coastline, two coupling points spaced along the fin, and two links which are each connected between an anchoring point and a coupling point so as to intersect one another. The anchoring points may, for instance, comprise sea anchors, i.e. anchoring devices that are embedded in the sea bottom.

Alternatively, the suspension arrangement may include a fixed post, a fixed block or like element, and a centered U-shaped element on the rear side of the fin, wherein the post extends through the U-shaped element and wherein the U-shaped element is constructed to allow the fin to self-adjust in accordance with the abovementioned pattern for waves incoming in different directions.

A system for protecting a coastline or beach against erosion may include a plurality of protective arrangements mounted along the coastline.

When applying the inventive technique, a reduction in erosion can be expected by virtue of the fact that the invention retards the coast-parallel transportation of erosion material or sand, wherewith this erosion limiting effect can also result in a build-up of the coastline concerned, because the sedimentation possibilities with respect to coast-parallel material transportation are favoured. The invention can therefore also be applied to build-out or extend a coastline that would otherwise be kept constant or be eroded due to coast-parallel water flows and currents.

The fins will preferably be placed in the water in the coast zone where the incoming waves are broken, i.e. where the incoming waves generate water flows that cause erosion and the transportation of material.

The fin may beneficially be arranged to float in the water close to the surface thereof, wherewith the vertical extension of the fin, or its height, will preferably correspond to about half the depth of the water in the proximity of the fin. The fin will suitably have a height which corresponds at most to 0.9 times the depth of water. The fin may have a length of, for example, 3–5 m, although the length of the fin will depend primarily on the mechanical strength requirements in respect of the wave climate concerned.

The fin may be moored or tethered with a line that will prevent the fin from moving away from the beach to any great extent, for instance in the case of an off-shore wind. The mooring line, or some other corresponding device, may be arranged to restrict the angle of the fin relative to the incoming waves, where the wave direction causes the fin to adopt an angle that exceeds a given value from the coastline.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention will now be described in more detail with reference to exemplifying embodiments thereof and also with reference to the accompanying drawings, in which

BRIEF DESCRIPTION OF THE DRAWINGS

FIG. 3 is a sectional view taken on the line III—III in FIG. 2;

FIG. 4 illustrates another embodiment of the inventive arrangement;

FIG. 5 illustrates the arrangement of FIG. 4 influenced by waves that define an angle with the coastline;

DESCRIPTION OF THE INVENTION

Figure 1:
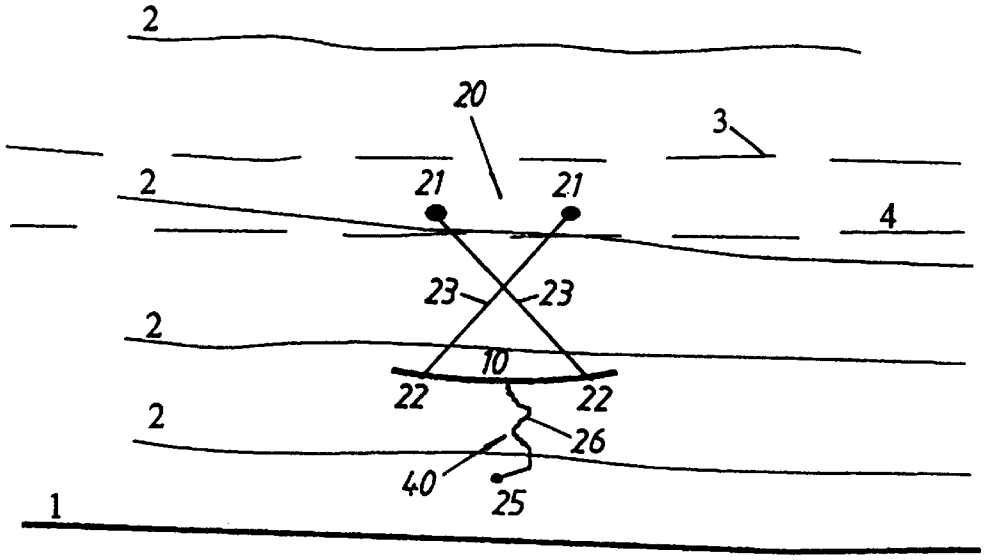
FIG. 1 illustrates an inventive arrangement from above.

Shown in FIG. 1 is a coastline 1 and essentially parallel waves 2 that break in a breaking zone whose outer limit is indicated by the broken line 3. The sea and the coastline 1 will be affected by breaking of the waves 2. This can result in erosion of the coastline 1 and the suspension of sea-bed material.

The inventive arrangement comprises a fin 10 that is placed in the wave breaking zone 4 between the lines 1 and 3 shown in the figure. Because the waves 2 are generally parallel with the coastline 1, the fin 10 is mounted so as to extend generally parallel with the coastline 1. The fin 10 is suspended from a suspension arrangement 20, so as to enable the fin 10 to be angled relative to the coastline 1, in dependence on the direction of the incoming waves 2. As shown in FIG. 1, this suspension arrangement is comprised of two anchoring points 21, achieved with sea anchors or the like embedded in the sea bed. The fin 10 has two connection points 22 that are mutually spaced along the fin 10 and that lie essentially equidistantly from the longitudinal centre of the fin 10. (The distance between the anchoring points 21 is, as a rule, much shorter than the distance between the connection points 22, although the ratio of said points will depend on the "lift-coefficient" of the fin). Connecting elements 23, for instance links or wires, extend between the points 21 and 22 while intersecting one another. The fin 10, which may have a length in the order of 3–5 m, is suitably arranged to float with its upper edge in the proximity of the surface of the water, wherewith the fin will have a height in the region of 0.3–0.9 d where d is the depth of water at the fin 10. The perpendicular distance to the coastline 1 between the points 21 and 22 may be 5,6 m for instance. As evident from FIG. 3, links 23 may extend directly or with a division between 21 and 23 from respective anchoring points 21 to the upper edge and bottom edge of the fin 10, so as to hold the fin in a chosen, generally vertical position.

Figure 2:
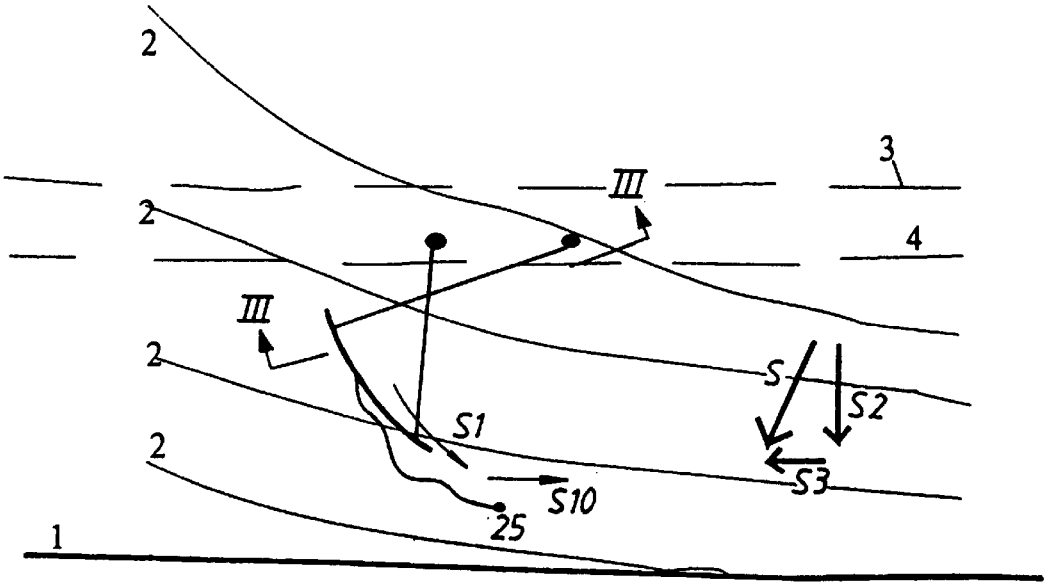
FIG. 2 shows the fin of said arrangement angled in relation to the coastline as a result of incoming waves defining an angle therewith.

The suspension arrangement 20 is constructed to set a larger angle between the longitudinal axis of the fin 10 and the coastline 1 when the waves 2 begin to define an angle with the coastline l, as in the case illustrated in FIG. 2.

The flow of water in towards the coast resulting from the breaking wave will be dampened when the wave passes generally at right angles over the longitudinal axis of the fin 10, although the angular difference between the fin 10 and the wave 2 will cause a part S1 of the fluid flow of the wave to be deflected along the fin 10. As indicated generally to the right of FIG. 2, the fluid flow S resulting from the wave 2 can be divided into a component S2 which is perpendicular to the coastline 1, and a component S3 which is parallel with the coastline. Correspondingly, the fluid flow S1 will be divided into a component that is perpendicular to the coastline 1 and a component S10 which is parallel with the coastline 1. It will be evident from FIG. 2 that the component S10 moves in a direction opposite to the component S3. The component S10 is thus able to slow down the coast-parallel fluid flow and the material transportation created by the component S3, thereby enabling the transportation of material, e.g. sand, from the coastal region inwardly of the fin to be counteracted. This effect is thus able to limit erosion of the coastline 1 or to promote an extension of the coastline, as a result of establishing more favourable sedimentation conditions for material suspended in the water in the region of the inventive arrangement.

As can be seen from FIG. 1, means are provided for limiting the angle to which the fin 10 is inclined relative to the coastline 1. These means 40 are also adapted to keep the fin 10 in the region between the coastline 1 and the anchoring points 21 in the event of an off-shore wind or in the event of other conditions that strive to move the fin 10 outside the anchoring points 21.

The means 40 comprise an anchoring point 25 on the sea bottom, for instance in the form of a sea anchor or like arrangement, a line 26 which is coupled between the anchoring point 25 and the fin 10 and the length of which determines the swinging area of the fin 10 and thus the angle positioning area relative to the anchoring arrangement formed by the anchoring points 21.

FIG. 4 illustrates an alternative embodiment of the invention, comprising a vertical post/block 31 stationarily mounted on the sea bottom, and a generally U-shaped element 32 which is mounted centrally on the outwardly facing side of the fin 10. The post/block 31 is received in the area defined by the U-shaped element 32 and the fin 10. The U-shaped element 32 is symmetrical relative to a central vertical plane and has its deepest part in its symmetry plane, wherein the U-shaped element 32 is constructed in general so as to give the fin a larger angle of inclination relative to the coastline 1 than the angle between the incoming waves 2 and the coastline 1, so that the U-shaped element 32 in co-act ion with the post 31 will cause the fin 10 to operate in generally the same way as in the embodiment according to FIG. 1.

In order that respective corner regions 321 of the generally U-shaped element 32 shall be displaced into contact with the post 31, such that the fin 10 will give rise to the desired, deflected flow component for the corresponding obliquely incoming wave, there is provided a setting arrangement 40.

This setting arrangement 40 may include a line 33 that extends between the legs of the U-shaped element, wherein a running block 34 is arranged to run on the line 33. The block 34 is, in turn, connected to a line 35 that extends through a running-eye 121 carried by an anchor anchored to the ground/sea bottom, wherein one end of the line 35 is connected to a buoy 36 whose position of boyancy is such as to generate a tensile force in the line 35. Alternatively, the line 35 may be replaced with an elastic line or the like that is anchored to the ground in the indicated position, namely between the fin 10 and the coastline 1. The angle at which the fin is inclined is determined by the balance between the force that acts perpendicularly on the fin, the shearing stress exerted by the fin on the deflected water flow, and the force in the line 35. The line 35 may also be used to define the maximum angle of inclination of the fin when contact is made between the buoy 36 and the eye or loop 121.

The post 31 can be replaced with a running block which accommodates the U-shaped element 32 and which, in turn, is supported from some fixed point.

In the embodiment illustrated in FIG. 3, the stabilizing line 23, 23' extends fully from respective anchorage points 21 to the fin 10, although it will be understood that the lines 23, 23' may be mutually joined at a short distance behind the fin 10, wherewith a single connecting line extends from the anchoring point 21 to the point at which the lines 23, 23' are joined.

Littoral (coast-parallel) sediment transportation is described as a rule with the aid of different empirical expressions. A common feature of all these descriptions is the high significance of the wave's angle, i.e. the wave crest angle, to the coast, since the coast-parallel component of the wave is directly dependent on this angle. If it is assumed that the fin is able to "twist" a part of this wave crest such that it will approach the coast from an opposite direction (with a coast-parallel component in an opposite direction), it will enable the erosion inhibiting properties of the fin to be related to the natural transportation of sediment.

EXAMPLE

Ex: The CERC-formula for calculating coast-parallel sediment $$Q = \frac{K}{(p_s - p)g'a} P_{ls} \qquad [A]$$

where Q=sediment transport, K=coefficient, $p_s$=sand density, p=water density, g=gravitational constant, a'=sand porosity The term $p_{ls}$ describes the coast-parallel component of the wave energy flux.

$$P_{ls} = \frac{pg}{16} H_{ab}^2 C_{gb} \sin 2\alpha_b \qquad [B]$$

where $H_{sb}$=significant wave height of the breaking wave, $C_{gb}$=the group velocity of the breaking wave, $a_b$=the angle of the breaking wave to the coast.

Assume that the fin changes direction of part of the wave to angle −a'. Sediment transportation will then be influenced in two ways, firstly that part of the wave which changed direction to −a' will brake the natural transportation of sediment, and secondly the energy flux in the original direction $a_b$ will be smaller. It is believed that the influence of the fin on sediment transportation can be described as $$F_{ls} = A\left[\frac{pg}{16} H_{sb}^2 C_{gb} \sin 2\alpha_b + \eta \frac{pg}{16} H_{sb}^2 C_{gb} \sin 2\alpha'\right] \qquad [C]$$

and the influence of Q as:

$$Q = \frac{K}{(p_s - p)g'a}(P_{ls} - F_{is}) \qquad [D]$$

The term η describes a sort of fin efficiency (i.e. how much of the wave energy changes direction) and A describes how much of the wave energy flux is influenced. The terms will probably be dependent on the configuration of the fin (shape, height and length) and the angle of attack of the fin, and the distance between the fins with respect to a whole system. The angle a' will be dependent on the angle of the incoming wave to the coast and also to the attack angle and configuration of the fin.

It is necessary to determine a desired design angle before the forces that act on the fin can be calculated (under normal conditions). Laboratory trials indicate that the optimal angle ϕ between the fin and the wave crest is about 40°. Coast-parallel lines in FIG. 6. are designated 1'.

Figure 6:
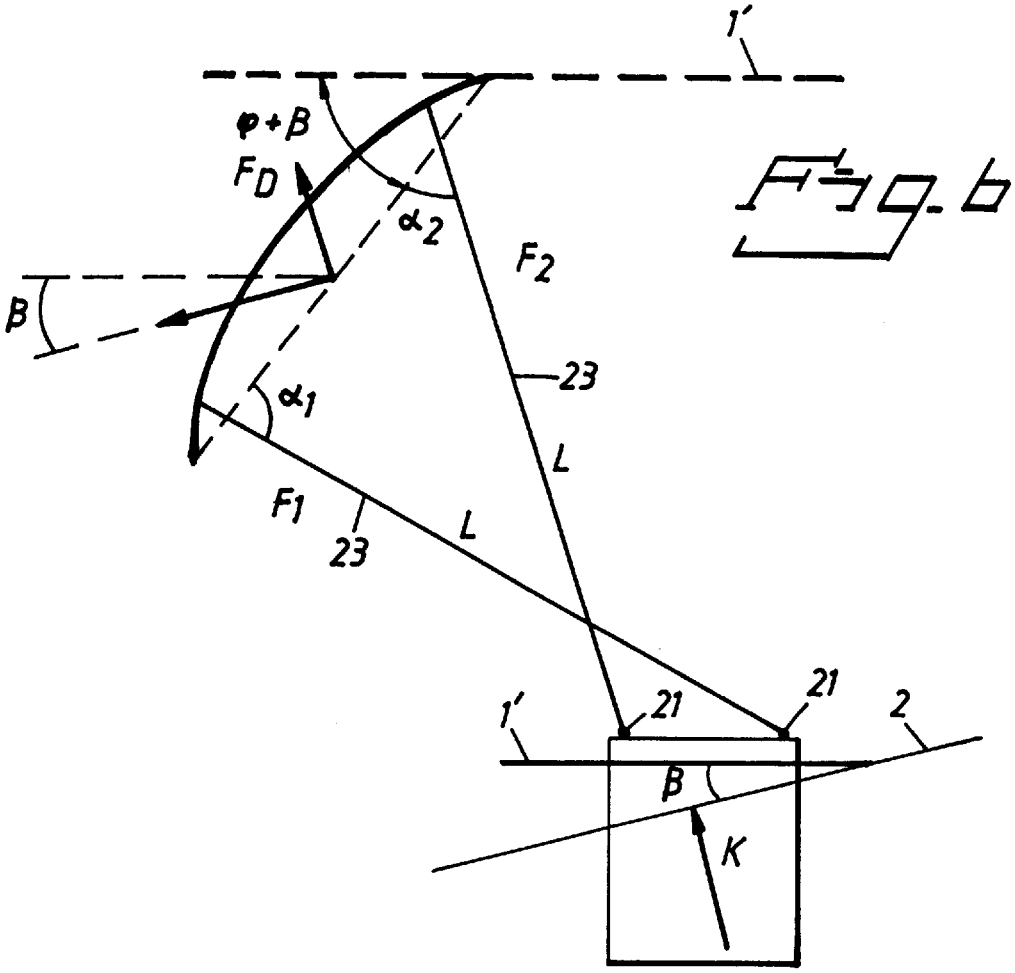
FIG. 6 illustrates an inventive arrangement from above, with geometric signs.
Figure 7:
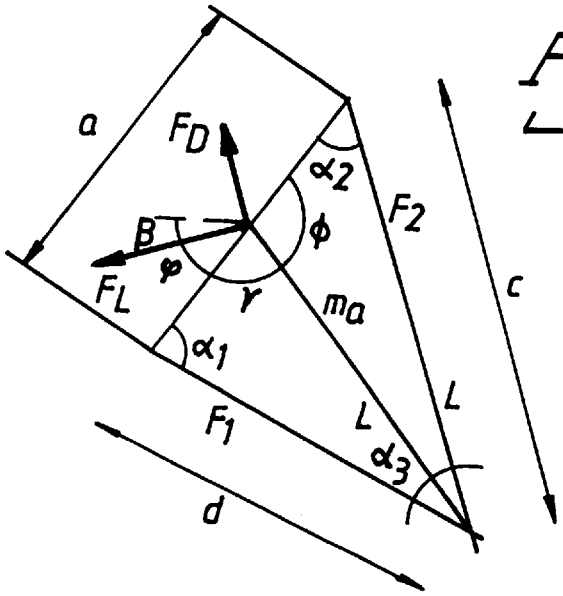
FIG. 7 is a schematic version of FIG. 6 as a basis for the geometrical relationships.

The design angle ϕ (FIG. 6) will be a function of the angles a, and $a_2$ which, in turn, depend on the "lifting capacity" of the fin and the length L, a and b (cf also FIG. 7).

Some geometrical relationships based on FIG. 7, which in turn is based on FIG. 6 are listed below.

$$\sin\phi = \sin\gamma = \frac{2\sin\alpha_1\sin\alpha_2}{\sqrt{2\sin^2\alpha_1 + 2\sin^2\alpha_2 - \sin^2(\alpha_1+\alpha_2)}} \quad [A]$$

$$\sin\alpha_2 = \sin\alpha_1 - \frac{b}{L}\sin(\varphi+\beta) \quad [B]$$

$$\cos\alpha_2 = \frac{a}{L} + \frac{b}{L}\cos(\varphi+\beta) - \cos\alpha_1 \quad [C]$$

$$L = \frac{a\sin\alpha_2 + b\sin(\alpha_2 + (\varphi+\beta))}{\sin(\alpha_1+\alpha_2)} \quad [D]$$

$$0 = \sin\alpha_1 - \sin\alpha_2 - \frac{b\sin(\alpha_1+\alpha_2)\sin(\varphi+\beta)}{a\sin\alpha_2 + b\sin(\alpha_2+\varphi+\beta)} \quad [B+D]$$

Force and moment equilibrium $$M1: F_2\sin\alpha_2 - \frac{F_D}{2}\cos\varphi - \frac{F_L}{2}\sin\varphi = 0 \Rightarrow \quad [E]$$

$$F_2 = \frac{F_L\sin\varphi + F_D\cos\varphi}{2\sin\alpha_2}$$

$$M2: F_1\sin\alpha_1 - \frac{F_D}{2}\cos\varphi - \frac{F_L}{2}\sin\varphi = 0 \Rightarrow \quad [F]$$

$$F_1 = \frac{F_L\sin\varphi + F_D\cos\varphi}{2\sin\alpha_1}$$

$$[E] + [F] \Rightarrow F_1\sin\alpha_1 = F_2\sin\alpha_2$$

$$M3: m_a F_D\sin(\gamma+\varphi) - m_a F_L\sin(\phi-\varphi) = 0 \Rightarrow \quad [G]$$

$$\frac{F_D}{F_L} = \frac{\sin(\phi-\varphi)}{\sin(\phi+\varphi)}$$

$$\beta:\ F_L - F_1\cos(\alpha_1-\varphi) + F_2\cos(\alpha_2-\varphi) = 0 \quad [H]$$

$$\beta - 90°:\ F_D - F_1\sin(\alpha_1-\varphi) - F_2\sin(\alpha_2+\varphi) = 0 \quad [J]$$

$$\frac{F_D}{F_L} = \frac{\sin\alpha_2\sin(\alpha_1-\varphi) + \sin\alpha_1\sin(\alpha_2+\varphi)}{\sin\alpha_2\cos(\alpha_1-\varphi) - \sin\alpha_1\cos(\alpha_2+\varphi)} \quad \frac{[J]}{[H]} = [K]$$

The ratio $F_D/F_L$ ($C_D/C_L$, tow/lift coefficient) and the length a will be specific for a given fin. The parameters L and b (and therewith also the angles $a_1$ and $a_2$) need to be adapted so that the desired design angle, $\phi$, will be obtained for the largest possible span of $\beta$ (the angle of the incoming wave).

EXAMPLE

Assume: $F_D/F_L$=1.5 (relatively high value) for $\phi$=45°
Choose: a (distance between attachments 22 on the fin)=4 m Step 1

The fins are first dimensioned so that they self-adjust to the desired design angle at the dominating wave direction.

EXAMPLE

Set $\phi$=45°, $\beta$=20°.
L, b, $a_1$ and $a_2$ are taken from the equation [K] and [B+D]. Ex
a=4 m, $\phi$=45°, $\beta$=20°, gives
$F_D/F_L$=1.5 (for one type of fin), L=6.48, b=0.85, $a_1$=80° and $a_2$=60°.

Step 2

It is of interest to obtain an understanding of to which angle the fin will self-adjust in other wave directions.

Assume a value for $\phi+\beta$. Use equation [B] and [C] (with L and b from step 1) to find $a_1$ and $a_2$. Use equation [K] or [G] to obtain the relationship between $F_D/F_L$ and $\phi$ ($F_D/F_L$ varies with $\phi$, depending on the configuration of the fin). (Assume for the sake of it that $F_D/F_L$=1.5 for all $\phi$).

| $\phi$ + b | $a_1$ | $a_2$ | $\phi$ | $\beta$ |
|---|---|---|---|---|
| 50° | 77.4° | 61.1° | 43.0° | 7° |
| 60° | 79.2° | 60.3° | 44.4° | 15.6° |
| 70° | 80.9° | 59.8° | 45.6° | 24.4° |
| 80° | 82.3° | 59.5° | 46.5° | 33.5° |

The anchoring lines will preferably be constructed so that they will not both break in the event of a breakdown. In the case of extreme loads (i.e. loads greater than the dimensioned load), one line will preferably be able to break before the other line, therewith reducing the load on the remaining line and enhancing its possibilities of retaining the fin until it can be repaired.

Because the fins float in the water, some form of warning mark should be fixed to the fin, for instance a flag or mark similar to those used to show the presence of fishing gear at sea.

In order to prevent the fin floating away from the coast, e.g. as the result of off-shore winds, some form of restricting line will preferably be used inwardly towards the coast. This line can also be used to give the fin a maximum angle to the coast.

The lines will preferably be dampened, so as to reduce wear and the risk of breakdown or displacement of the bottom anchorage. It is proposed in this respect that some form of spring is used, for instance rubber springs, and that the springs are connected parallel with a short section of the line, so as primarily to take-up jerks in the line by stretching elastically. Such springs are used for dampening jerks in the mooring lines of leasure craft and are available commercially.

The illustrated embodiments include a suspension means which, in co-action with the fin 10, gives the fin the desired angular setting in relation to the incoming waves, so that the fin will generate therealong a current or flow that counteracts the coast-parallel flow component of the waves that are angled to the coast line.

In the embodiment shown in FIG. 1, the fin 10 is parallel with the coast line 1 and the waves 2 are also parallel with the coastline 1. It will be understood, however, that the suspension means 20 can be constructed to hold the fin 10 in a non-parallel relationship with the line I and the waves 2. For instance, if it is known that the coast suffers a net loss of material/sand to the "left" in FIG. 1, the lengths of the lines 23 can be adapted so that the fin will deflect a water-flow component to the "right" in FIG. 1, even when the incoming waves are parallel with the coastline.

The side of the fin that faces towards the waves has been shown to be concave in the horizontal plane, this curvature being sufficiently large to ensure that the part of the fin that faces towards the coastline will approach the coastline direction with a given wave direction (e.g. the dominant wave direction). However, the curvature of this surface should not be so large as to risk flow being deflected outwards from the coastline for other frequently occurring wave directions. Naturally, the deflecting side of the fin may be straight.

The purpose of a curvature is to guide the coast-parallel flow component generated at the fin in certain cases. The curvature can otherwise be said to function to improve the lifting coefficient of the fin.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A method of protecting part of a coast against erosion, which comprises the steps of:

placing outside a coastline in a wave breaking zone a device to dampen water flow generated by breaking waves in the wave breaking zone, using the device to dampen the water flow generated by said breaking waves, said device shaped as an elongated fin with a longitudinal axis lying generally in a horizontal plane parallel to the water surface, supporting the fin with a suspension arrangement so that it can swing in the horizontal plane, adjusting the fin in the horizontal plane so as to cause the longitudinal axis of the fin to be at an angle relative to the coastline for deflecting from said water flow a component that counteracts with a generally coast-parallel water flow component originating from said breaking wave that is not parallel with the coastline, increasing the fin angle relative to the coastline when the wave angle relative to the coastline increases, and decreasing the fin angle relative to the coastline when the wave angle relative to the coastline decreases.

2. A method according to claim 1, wherein the step of supporting comprises the steps of: mounting the fin in the suspension arrangement which is influenced by the direction of the incoming waves, and setting the direction of the fin in dependence on the direction of the incoming waves.

3. A method according to claim 1, said method comprising the step of adjusting the suspension arrangement to hold the fin in a chosen direction relative to the coastline in respect of waves that define a chosen angle relative to the coastline.

4. An arrangement for protecting part of a coastline against erosion, said arrangement comprising:

a device placed outside the coastline in a wave breaking zone for dampening water flow generated by breaking waves in the wave breaking zone, wherein said device is an elongated fin with a longitudinal axis orientated in a chosen first fin orientation and forming a fin angle for causing the fin to deflect, from the breaking waves in the breaking wave zone, a first flow component that counteracts a coast-parallel water flow component originating from a breaking wave that is not parallel with the coastline; and a suspension arrangement for carrying said fin and enabling the fin to swing in a horizontal plane parallel to the water surface, said suspension arrangement being constructed to increase the fin angle relative to the coastline when the angle of the waves relative to the coastline increases, and being constructed to decrease the fin angle relative to the coastline when the angle of the waves relative to the coastline decreases.

5. An arrangement according to claim 4, wherein the suspension arrangement is constructed to set the fin angle relative to said angle of said waves.

6. An arrangement according to claim 5, wherein the suspension includes two anchoring points anchored in said breaking wave zone and separated along a line; said fin having two mutually separated connection points on respective sides of and at a substantial distance from its length centre; and two couple links extending between said respective anchorage points and said connection points while intersecting one another, said links, anchoring points and fin being connected together and forming a bar mechanism.

7. An arrangement according to claim 4, wherein the suspension arrangement is constructed to increase the fin angle relative to the waves with increasing wave angles relative to the coastline, and being constructed to decrease the fin angle relative to the waves with decreasing wave angles relative to the coastline.

8. An arrangement according to claim 4, wherein the fin has the form of a water-buoyant structure whose upper edge is located in the proximity of the surface of the water; and in that the fin has a vertical height corresponding to from 20–90% of the depth of the water at the fin.

9. An arrangement for protecting part of a coastline against erosion, said arrangement comprising:

an elongated fin placed outside the coastline in a wave breaking zone for dampening waves generated by breaking waves, said elongated fin having a longitudinal axis orientated in a chosen first fin orientation and forming a fin angle for causing the fin to deflect, from breaking waves in the breaking wave zone, a first flow component that counteracts a coast-parallel water flow component originating from a breaking wave that is not parallel with the coastline;

a suspension arrangement for carrying said fin and enabling the fin to swing in a horizontal plane parallel to the water surface, said suspension arrangement being constructed to increase the fin angle relative to the coastline when the angle of the waves relative to the coastline increases, and being constructed to decrease the fin angle relative to the coastline when the angle of the waves relative to the coastline decreases;

the suspension arrangement includes a vertical, fixed post and an element having legs with ends, wherein the ends of the legs of said element are connected to the fin generally equidistantly from a length centre of the fin, and wherein the post extends through the space between the element and the fin.

10. A method of protecting a coastline against erosion which comprises the steps of:

placing a device in the shape of an elongated fin in a wave breaking zone of water outside said coastline to dampen water flow generated by breaking waves in the wave breaking zone, said fin having a longitudinal axis line generally in a horizontal plane parallel to the water surface;

supporting said fin with a suspension arrangement so that it can swing in the horizontal plane;

allowing of the fin to adjust in the horizontal plane so as to cause the longitudinal axis of the fin to deflect said water flow component that counteracts a generally coast-parallel water flow component originating from breaking waves that are not parallel to said coastline.

11. The method of claim 10, wherein the step of allowing the fin to adjust comprises the steps of:

increasing the fin angle relative to the coastline when the wave angle relative to the coastline increases, and decreasing the fin angle relative to the coastline when the wave angle relative to the coastline decreases.

12. The method according to claim 10, wherein the step of placing comprises the steps of:

mounting the fin in the suspension arrangement which is influenced by a direction of the incoming waves; and setting a direction of the fin in dependence on the direction of the incoming waves.

13. The method according to claim 12, further comprising the steps of:

adjusting the suspension arrangement to hold the fin in a chosen direction relative to the coastline in respect of waves that define a chosen angle relative to the coastline.

14. The method according to claim 10, wherein the step of allowing the fin adjust comprises the steps of:

causing a fin angle relative to the direction of the waves to increase with a climbing angle for the waves relative to the coastline; and causing the fin angle relative to the direction of the waves to decrease with a decreasing angle for the waves relative to the coastline.

15. An arrangement for protecting a coastline against erosion caused by waves breaking in a body of water adjacent to said coastline, said body of water having a surface and a seabed underneath, and said waves breaking at an angle to said coastline to cause a generally coast-parallel flow component to said water, said arrangement comprising an elongated fin having a longitudinal axis oriented in a horizontal plane generally parallel to said water surface, said fin adapted to float adjacent said water surface and dampen said breaking waves; and a suspension system connected to said fin and anchored to said seabed which causes said fin to swing in the horizontal plane and position said fin at an angle to said coastline to create a flow component from said breaking waves that counteract said coast-parallel water flow component.

16. The arrangement according to claim 15, wherein the suspension system is constructed to increase the fin angle relative to the waves with increasing wave angles relative to the coastline, and being constructed to decrease the fin angle relative to the waves with decreasing wave angles relative to the coastline.

17. The arrangement according to claim 15, wherein the suspension system includes two anchoring points anchored in said breaking wave zone and separated along a line; two mutually separated connection points on respective sides of said fin, and said points positioned at a substantial distance from the length center of said fin; and two couple links extending between said respective anchorage points and said connection points while intersecting one another, said links, anchoring points and fin being connected together and forming a bar mechanism.

18. The arrangement according to claim 15, wherein said suspension system further comprises:

a vertical, fixed post and an element having legs with ends, wherein the ends of the legs of said element are connected to the fin generally equidistantly from a length center of the fin, and wherein the post extends through the space between the element and the fin.

* * * * *